US005654893A

United States Patent [19]

Vermesse

[11] Patent Number: 5,654,893

[45] Date of Patent: Aug. 5, 1997

[54] AUTOMATING DATING SYSTEM FOR A POSTAGE METER

[75] Inventor: Bernard Vermesse, L'Hay Les Roses, France

[73] Assignee: Neopost Industrie, Bagneux, France

[21] Appl. No.: 594,091

[22] Filed: Jan. 30, 1996

[30] Foreign Application Priority Data

Jan. 31, 1995 [FR] France ..... 95 01106

[51] Int. Cl.[6] ..... G07B 17/00

[52] U.S. Cl. ..... 364/464.18; 101/71

[58] Field of Search ..... 101/71; 364/400, 364/464.02, 464.03

[56] References Cited

U.S. PATENT DOCUMENTS

| | | | |
|---|---|---|---|
| 3,869,986 | 3/1975 | Hubbard | 101/91 |
| 4,649,489 | 3/1987 | Denzin | 364/145 X |
| 4,673,303 | 6/1987 | Sansone et al. | 101/91 X |
| 4,858,138 | 8/1989 | Talmadge | 364/464.02 |
| 5,075,862 | 12/1991 | Doeberl et al. | 395/117 |
| 5,154,118 | 10/1992 | Doery et al. | 101/91 |
| 5,197,042 | 3/1993 | Brookner et al. | 368/10 |
| 5,200,903 | 4/1993 | Gilham | 364/464.02 |
| 5,508,933 | 4/1996 | Abumehdi | 364/464.02 |

FOREIGN PATENT DOCUMENTS

| | | |
|---|---|---|
| 0540022A2 | 5/1993 | European Pat. Off. . |
| 2207095A | 1/1989 | United Kingdom . |
| WO8801818 | 3/1988 | WIPO . |

*Primary Examiner*—Edward R. Cosimano

*Attorney, Agent, or Firm*—Sughrue, Mion, Zinn, Macpeak & Seas

[57] ABSTRACT

A postage meter comprising print means for printing a postage imprint including a posting date on an article of mail to be posted, an adjustment system for adjusting the posting date printed by the print means and including a processor connected to a calendar clock to receive a current date and controlling the print means to cause a postage imprint to be printed with a current posting date established on the basis of the current date. The processor is also programmed to prevent the postage imprint being printed when the current posting date for printing corresponds to a date on which the postal authorities are closed or a particular date defined by the user of the meter.

4 Claims, 3 Drawing Sheets

FIG. 3

TAB1

MM-1

| | | |
|---|---|---|
| 0 | → | 0 |
| 1 | → | 31 |
| 2 | → | 60 |
| 3 | → | 91 |
| 4 | → | 121 |
| 5 | → | 152 |
| 6 | → | 182 |
| 7 | → | 213 |
| 8 | → | 244 |
| 9 | → | 274 |
| 10 | → | 305 |
| 11 | → | 335 |
| 12 | → | 366 |

TAB2

MM-1

| | | |
|---|---|---|
| 0 | → | 0 |
| 1 | → | 31 |
| 2 | → | 59 |
| 3 | → | 90 |
| 4 | → | 120 |
| 5 | → | 151 |
| 6 | → | 181 |
| 7 | → | 212 |
| 8 | → | 243 |
| 9 | → | 273 |
| 10 | → | 304 |
| 11 | → | 334 |
| 12 | → | 365 |

AUTOMATING DATING SYSTEM FOR A POSTAGE METER

The invention relates to a postage meter or "franking machine" including a print mechanism for franking articles of mail, with a postage imprint that includes a posting date.

BACKGROUND OF THE INVENTION

The invention relates more particularly to a postage meter provided with a system for automatically adjusting the posting date in the postage imprint so as to be capable automatically of printing articles of mail with an imprint that includes a current posting date or a date later than the current date in order to make post-dating possible. This feature is particularly advantageous for a user who desires to frank articles of mail in advance.

OBJECT AND SUMMARY OF THE INVENTION

Such a postage meter is already known from document EP 540 022. The object of the invention is to further improve that meter.

To this end, the invention provides a postage meter comprising a print mechanism for printing a postage imprint including a posting date on an article of mail to be posted, an adjustment system for adjusting the posting date printed by the print mechanism and including a processor connected to a calendar clock to receive a current date and controlling the print mechanism to cause a postage imprint to be printed with a current posting date established on the basis of the current date. The processor is also programmed to prevent the postage imprint being printed when the current posting date for printing corresponds to a date on which the postal authorities are closed.

The posting date placed on an article of mail can start a time period for the addressee of the article of mail. Also, the posting date placed on each article of mail puts a burden on the postal authority to cause the article to reach its addressee within a certain period of time. It will therefore be understood that the invention contributes to avoiding situations where the use of a postage meter can lead to harm either for the addressees of metered articles of mail or for the postal authorities.

Detecting whether the current posting date corresponds to a day on which the postal authorities are closed can be performed simply by program by calculating a day number for the current posting date relative to a previously recorded reference date, and that requires little memory space.

BRIEF DESCRIPTION OF THE DRAWINGS

An embodiment of the invention is described in detail below.

FIG. 3 shows two tables used in operating the system shown in FIG. 1.

MORE DETAILED DESCRIPTION

Figure 1:
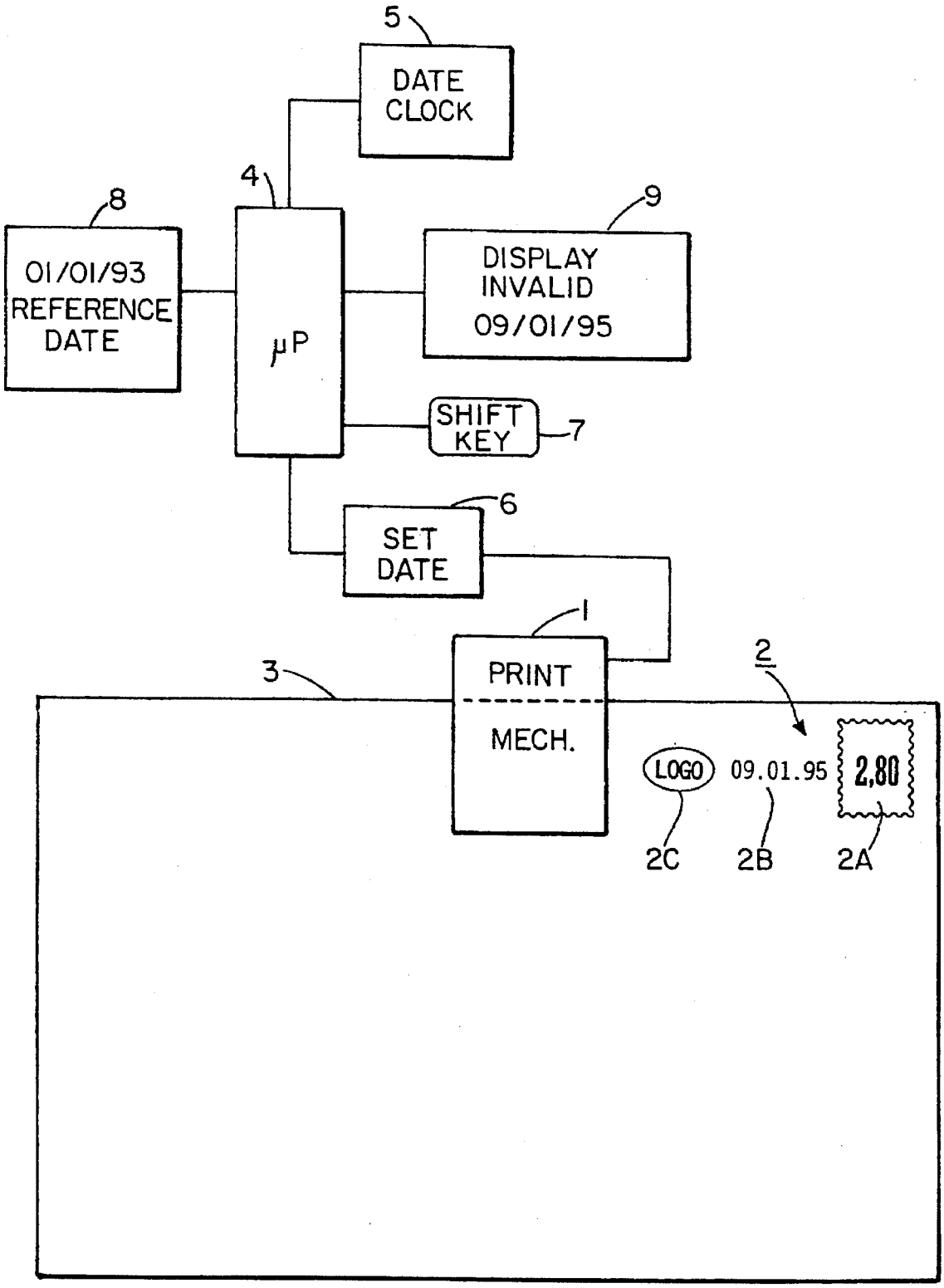
FIG. 1 is a block diagram showing the architecture of the system of the invention for automatically adjusting the posting date in a postage imprint.

In FIG. 1, the postage meter comprises a print mechanism 1 for printing a postage imprint 2 on an article of mail 3.

Conventionally, the postage imprint 2 includes a stamp 2A, a posting date 2B, and, where appropriate, an advertising slogan or logo 2C.

The print mechanism may be constituted by a rotary drum fitted with print wheels which serve to print each symbol constituting the postage amount, e.g. 2.80, and the posting date, e.g. 09 Jan. 1995 for 9 Jan. 1995.

An adjustment system is provided for adjusting the posting date that is to be printed by the print means. This adjustment system includes a processor 4 connected to a calendar clock 5 to receive information representing a current date. The processor 4 is also connected to the print mechanism 1 via a member 6 which serves to configure the print mechanism 1 to print a postage imprint including as its posting date a date supplied by the processor, e.g. the current date as obtained from the calendar clock. The member 6 may be constituted by micromotors acting on the above-mentioned print wheels.

In a variant, the processor 4 is connected to one or more input keys such as key 7. The key 7 serves to offset the posting date that is to be printed on articles of mail relative to the current date as supplied by the calendar clock so as to cause the postage meter to operate in post-dating mode. In particular, the processor 4 may respond to n depressions of the key 7 to advance the posting date to n days ahead of the current date. If the current date is 9 Jan. 1995 (09 Jan. 1995) and if the operator presses the key 7 twice (n is equal to 2), then the processor causes the print mechanism 1 to print 11 Jan. 1995, i.e. 11 Jan. 1995 as the posting date.

According to the invention, the processor 4 is also programmed to check the posting date (whether as provided by the calendar clock or as changed by the operator in post-dating mode) which is to be printed on each article of mail, and where appropriate to prevent the postage imprint being printed whenever the posting date corresponds to a day on which the postal authorities are closed, e.g. a Saturday or a Sunday.

Figure 2:
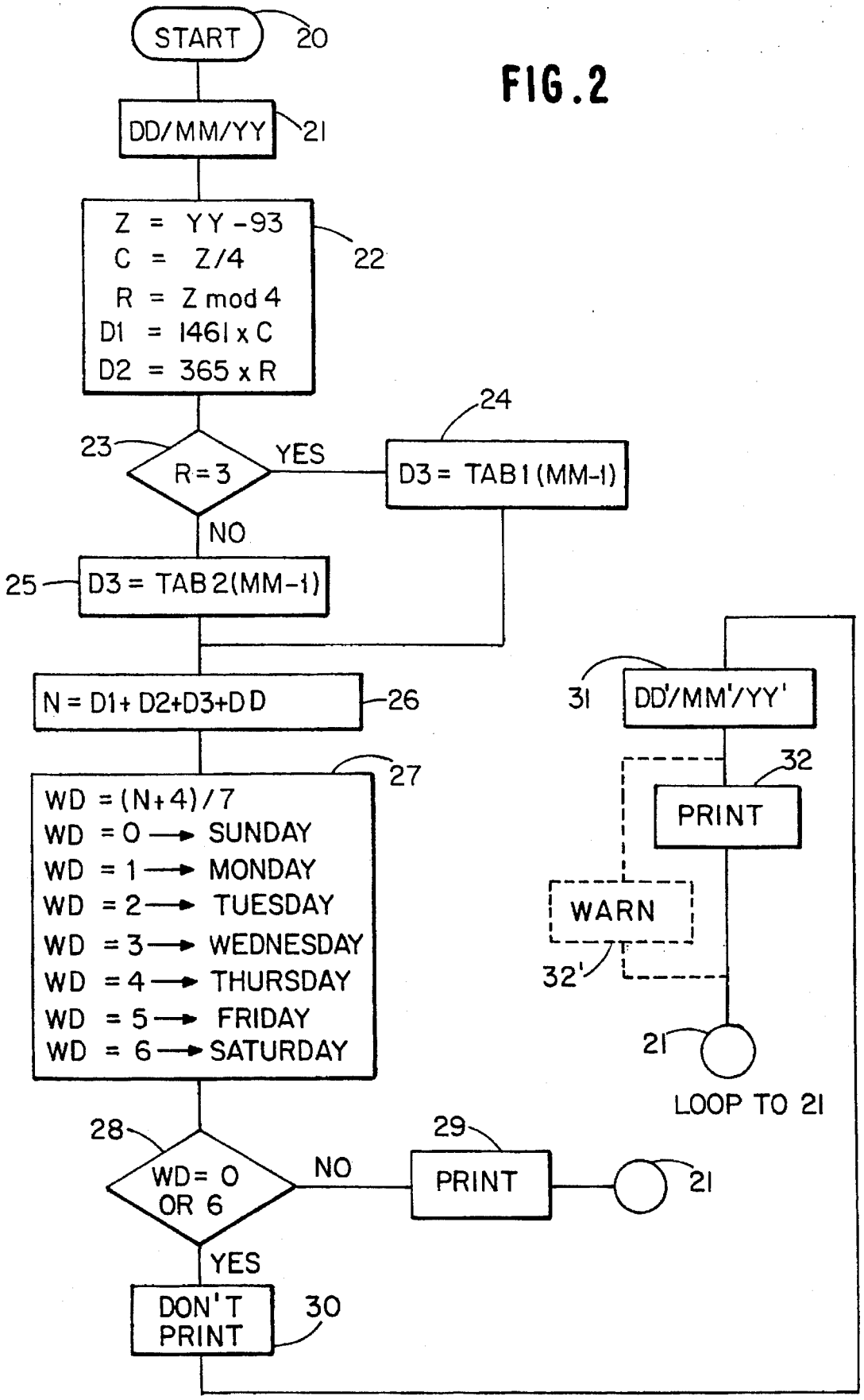
FIG. 2 is a flow chart illustrating the operation of the system shown in FIG. 1.

FIG. 2 shows the operation of the program controlling the processor 4 for detecting whether a date later than a reference date, in this case, 01 Jan. 1993 corresponds to a Saturday or a Sunday. The reference date is kept in a memory 8 connected to the processor 4. 1 Jan. 1993 was a Friday.

In FIG. 2, at the start of a metering cycle at step 20, the processor 4 begins by establishing at step 21 a first posting date expressed in the form "day-number/month-number/year", i.e. DD/MM/YY. This first date may be the current date supplied by the calendar clock 5 or a later date as adjusted by the operator by pressing the key 7. For example, if the posting date is 08 Jan. 1995, then DD is 8, MM is 1 and YY is 95. 8 Jan. 1995 was a Sunday.

At step 22, the processor calculates: a first value Z using the relationship Z=YY−93 (for 08 Jan. 1995, Z is equal to 2); a second value C using the relationship C=Z/4 (in this example C is equal to 0); a third value R which is the remainder of integer division of Z by 4 (in this example R is equal to 2); a fourth value D1 using the relationship D1=1461×C (in this example D1 is equal to 0); and a fifth value D2 using the relationship D2=365×R (in this case D2 is equal to 730).

At step 23, the processor 4 compares the value R with 3.

If the value R is equal to 3, then the processor performs a step 24 and extracts a sixth value D3 from its memory 8 using the relationship D3=TAB1(MM−1).

If the value R is not equal to 3, then the processor performs a step 25 where it obtains the value for D3 from its memory 8 by applying the relationship D3=TAB2(MM−1). It should be observed that TAB1 and TAB2 are two data tables shown in FIG. 3 and stored in the memory 8. In this example, D3 is equal to 0. In FIG. 3, each of the tables TAB1 and TAB2 comprises a set of values, each accessed by an index of value MM−1. The values of the indices are given by the numbers 0 to 12.

Thereafter, the processor in step 26 calculates a seventh value N using the relationship N=D1+D2+D3+DD. In this example, N is equal to 738.

In step 27, the processor determines an eighth value WD representative of a weekday using the relationship WD=integer remainder of (N+4)/7. This value WD lies in the range 0 to 6, 0 representing Sunday and 6 Saturday. In the present example, WD is equal to 0 which corresponds to Sunday.

The value WD is then tested in step 28. If WD is not equal to 0 or to 6, then the processor moves on to step 29 where it controls printing of a postage imprint including the posting date obtained in step 21, and it returns to step 21 for a new metering cycle. Otherwise, at step 30 it prevents the postage imprint being printed with the posting date since the date is a Sunday or a Saturday, and this applies in the present example.

Following step 30, the processor moves on to step 31 where it establishes a new and later date DD'/MM'/YY' corresponding to the first day on which the postal authority is open immediately following the day detected at step 27 as being a closed day, for example by adding one or two days to the date DD/MM/YY obtained in step 21. In this example, the subsequent date actually used is 09 Jan. 1995 which is a Monday.

In a first embodiment, the processor follows step 31 with a step 32 comprising an automatic command to the print mechanism 1 configured with the later date, after which it returns to step 21.

In a second embodiment, the processor moves to a step 32' where it displays a warning message on a display screen 9, e.g. "DATE INVALID" telling the operator that the selected posting date, e.g. 08 Jan. 1995 corresponds to a day when the postal authorities are closed, and in the present case is a Sunday. The later date as determined in step 31, in this case 09 Jan. 1995, is also displayed on the screen 9, and the processor waits for the operator to validate it prior to causing a postage imprint to be printed including said later date as its posting date.

The program corresponding to steps 20 to 32 or 20 to 32' requires little memory space. If other dates on which the postal authorities are closed need to be taken into account by the processor, such as holidays on fixed dates (Christmas, Independence Day, etc.), a simple solution consists in storing these particular dates in the memory 8 for checking purposes. Naturally, storing such dates requires additional space in the memory 8.

A table of particular days to be avoided can be input into the memory 8 so as to prevent a postage imprint being printed with such a date. This table may be defined by the user of the meter.

I claim:

1. A postage meter comprising print means for printing a postage imprint including a posting date on an article of mail to be posted, an adjustment system for adjusting the posting date printed by the print means and including a processor connected to a calendar clock to receive a current date and controlling the print means to cause a postage imprint to be printed with a current posting date established on the basis of the current date, the processor also being programmed to prevent the postage imprint being printed when the current posting date for printing corresponds to a date on which the postal authorities are closed or a particular date defined by the user of the meter.

2. A meter according to claim 1, in which the processor is programmed to cause a postage imprint to be printed with a posting date later than the current posting date when the current posting date corresponds to a date on which the postal authorities are closed.

3. A meter according to claim 2, in which the processor is programmed to cause said later posting date to be displayed on a display screen of the meter for the purpose of obtaining authorization to print a postage imprint with the said later posting date.

4. A meter according to claim 1, in which the processor is programmed to calculate a day number on the basis of a previously recorded reference date in order to detect whether the current posting date to be printed corresponds to a date on which the postal authorities are closed.

* * * * *